US008308276B2

(12) United States Patent
Togashi

(10) Patent No.: US 8,308,276 B2
(45) Date of Patent: Nov. 13, 2012

(54) LIQUID EJECTING HEAD AND LIQUID EJECTING APPARATUS

(75) Inventor: Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 225 days.

(21) Appl. No.: 12/698,797

(22) Filed: Feb. 2, 2010

(65) Prior Publication Data

US 2010/0194825 A1 Aug. 5, 2010

(30) Foreign Application Priority Data

Feb. 3, 2009 (JP) ..... 2009-022299

(51) Int. Cl.
*B41J 2/045* (2006.01)
*B41J 2/14* (2006.01)

(52) U.S. Cl. ..... 347/70; 347/50

(58) Field of Classification Search ..... 347/70
See application file for complete search history.

(56) References Cited

U.S. PATENT DOCUMENTS

2010/0123757 A1* 5/2010 Okazawa ..... 347/54

FOREIGN PATENT DOCUMENTS

JP 2000-218774 A 8/2000
JP 2004-074740 A 3/2004

* cited by examiner

*Primary Examiner* — Matthew Luu
*Assistant Examiner* — Lisa M Solomon
(74) *Attorney, Agent, or Firm* — Kilpatrick Townsend & Stockton LLP

(57) ABSTRACT

A liquid ejecting head includes: first and second pressure generating chambers which are provided in parallel on a flow path forming substrate such that each of the first and second pressure generating chambers forms a row so as to communicate with nozzle openings for ejecting liquids; first and second piezoelectric devices which causes the volumes of the first and second pressure generating chambers to change, respectively, through a vibration plate formed on the flow path forming substrate; a common fixing member which is arranged between the first and second piezoelectric devices at a position opposite to the first and second pressure generating chambers, a part of each of the first and second piezoelectric devices being bonded to the common fixing member; and a signal line film which has input terminals through which a driving signal for driving the first and second piezoelectric devices is supplied from the outside and output terminals through which the driving signal is supplied to the first and second piezoelectric devices, the signal line film having flexibility. In this case, the signal line film includes a first wiring portion having the input terminals and the output terminals for supplying the driving signal to the first piezoelectric device at one side face of the fixing member, and a second wiring portion extending from the first wiring portion to the other side face of the fixing member and having the output terminals for supplying the driving signal to the second piezoelectric devices.

4 Claims, 5 Drawing Sheets

LIQUID EJECTING HEAD AND LIQUID EJECTING APPARATUS

This application claims priority to Japanese Patent Application No. 2009-022299, filed Feb. 3, 2010 the entirety of which is incorporated by reference herein.

BACKGROUND

1. Technical Field

The present invention relates to a liquid ejecting head and a liquid ejecting apparatus. In particular, the invention is useful for a liquid ejecting head and a liquid ejecting apparatus when the invention is applied to a system in which liquids are ejected by driving piezoelectric devices of a longitudinal vibration type.

2. Related Art

As a representative example of liquid ejecting heads, there is known an ink jet recording head which discharges ink droplets from nozzle openings using pressure caused by displacement of piezoelectric devices, for example. As a type of such ink jet recording head, there is an ink jet recording head in which piezoelectric devices (piezoelectric vibrators) are longitudinally provided on a region opposed to pressure generating chambers, which communicate with nozzle openings, through a vibration plate (for example, see JP-A-2004-74740). In the ink jet recording head, ink droplets are discharged from the nozzle openings by causing the pressure generating chambers to expand and contract by utilizing longitudinal vibration of the piezoelectric devices. The longitudinal vibration is generated by applying voltage to the piezoelectric devices. The piezoelectric devices of such ink jet recording head are accommodated in accommodating portions of a head case (base), and are electrically connected to conductive pads on a wiring substrate (upper-side sealing plate) provided on the head case through a circuit substrate which is typically formed with an FPC or the like. That is to say, an output terminal that is one end of the circuit substrate is connected to the piezoelectric devices, while an input terminal that is the other end of the circuit substrate is connected to the conductive pads on the wiring substrate. Thus, a driving signal for driving each piezoelectric device is supplied to each piezoelectric device through the input terminal of the circuit substrate.

As an example of the ink jet recording head utilizing longitudinal vibration as described above, there is proposed an ink jet recording head having a configuration as follows (for example, see JP-A-2000-218774, p. 3, FIGS. 4 and 7). That is, one piezoelectric device unit is formed by fixing a number of piezoelectric devices, which are integrated, to a side face of a fixing member, and two piezoelectric device units are paired to be accommodated in an accommodating portion of a head holder to be disposed on the side faces of the head holder.

Reductions in size and the number of components are desired in the above-described ink jet recording head utilizing longitudinal vibration.

Note that reductions in size and the number of components are desired not only in the ink jet recording head which discharges inks but also in liquid ejecting heads which eject liquids other than inks.

An advantage of some aspects of the invention is to provide a liquid ejecting head and a liquid ejecting apparatus which are reduced in size and include fewer components.

SUMMARY

A liquid ejecting head according to an aspect of the invention includes first and second pressure generating chambers which are provided in parallel on a flow path forming substrate such that each of the first and second pressure generating chambers forms a row so as to communicate with nozzle openings for ejecting liquids; first and second piezoelectric devices which cause the volumes of the first and second pressure generating chambers to change, respectively, through a vibration plate formed on the flow path forming substrate; a common fixing member which is arranged between the first and second piezoelectric devices, at a position opposite to the first and second pressure generating chambers, a part of each of the first and second piezoelectric devices being bonded to the common fixing member; and a signal line film which has input terminals through which a driving signal for driving the first and second piezoelectric devices is supplied from the outside and output terminals through which the driving signal is supplied to the first and second piezoelectric devices, the signal line film having flexibility. The signal line film includes a first wiring portion having the input terminals and the output terminals for supplying the driving signal to the first piezoelectric devices at one side face of the fixing member, and a second wiring portion extending from the first wiring portion to the other side face of the fixing member and having the output terminals for supplying the driving signal to the second piezoelectric devices.

According to the aspect, since two rows of the piezoelectric devices can be bonded to one fixing member, intervals of nozzle openings opposed to each other can be shorter, resulting in reduction in size of an apparatus and higher printing density. Further, one signal line film is shared with two rows of the piezoelectric devices, thereby reducing the number of components.

The signal line film preferably includes a coupling portion coupling the first wiring portion to the second wiring portion by extending from the first wiring portion to the other side face of the fixing member, and a notch portion, which is provided at a region of the signal line film, close to the flow path forming substrate as compared to the coupling portion. Further, the signal line film is preferably configured such that an end face of the fixing member, which is bonded to the piezoelectric devices, is exposed through the notch portion. Accordingly, the piezoelectric devices can easily be positioned at predetermined positions and the fixing member can be fixed by using the exposed portion of the fixing member.

Further, a leg portion is preferably provided which is fixed to an end face of the fixing member between the first and second piezoelectric devices and defines the positions of the end faces of the first and second piezoelectric devices on the side of the vibration plate. Accordingly, height positions of the piezoelectric devices can be adjusted on the basis of the leg portion. In addition, a piezoelectric device unit can be easily assembled, and a reaction force generated by contraction of the piezoelectric devices can be supported.

Further, one driving IC arranged on the first wiring portion preferably drives each of the first and second piezoelectric devices. With this configuration, one driving IC can be shared with the first and second piezoelectric devices, thereby reducing the number of components.

Further, according to another aspect of the invention, a liquid ejecting apparatus includes the liquid ejecting head according to the above aspect.

According to the aspect, the liquid ejecting apparatus can reduce both size and the number of components.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
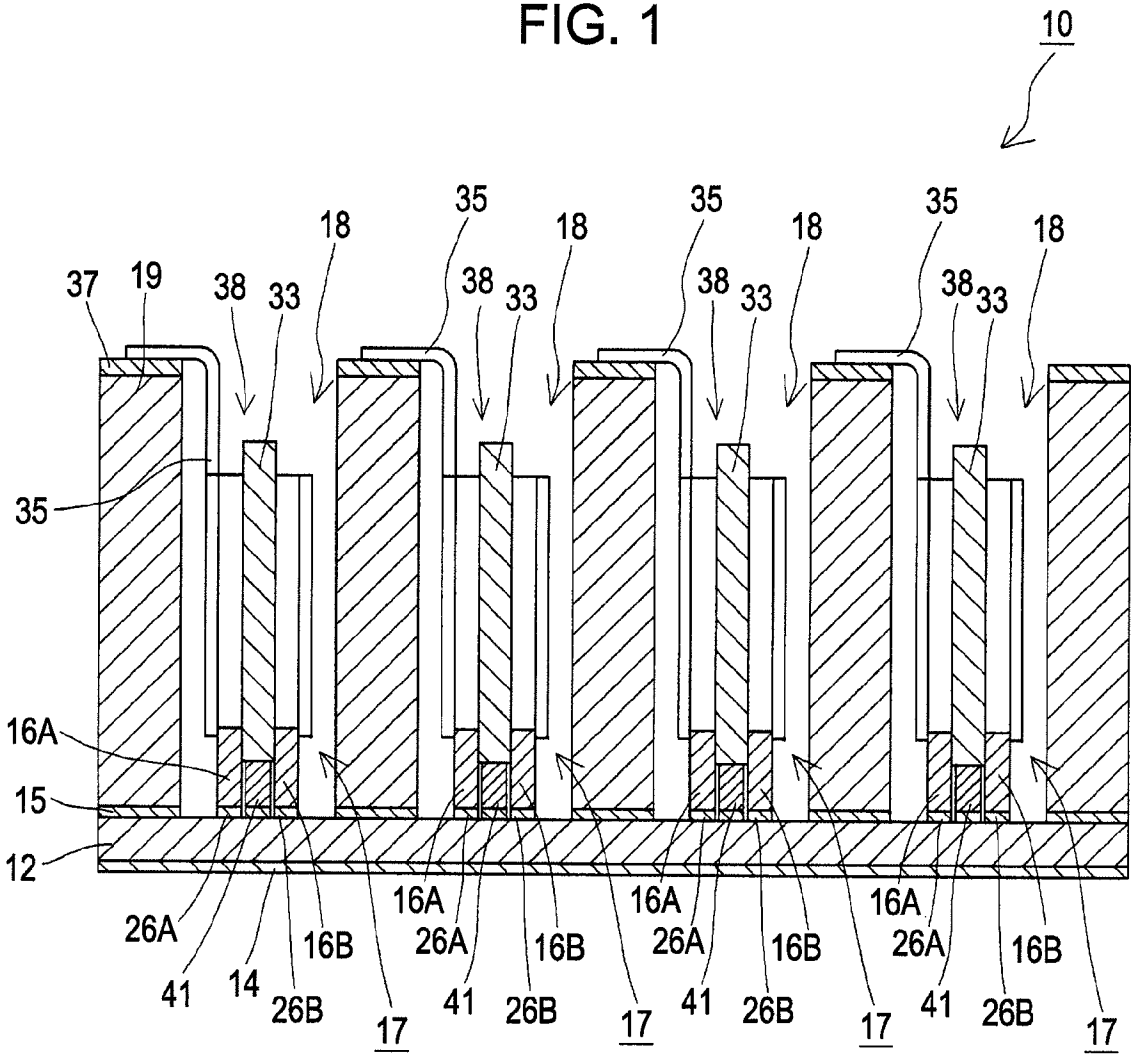
FIG. 1 is a schematic cross-sectional view illustrating a recording head according to an embodiment.
Figure 2:
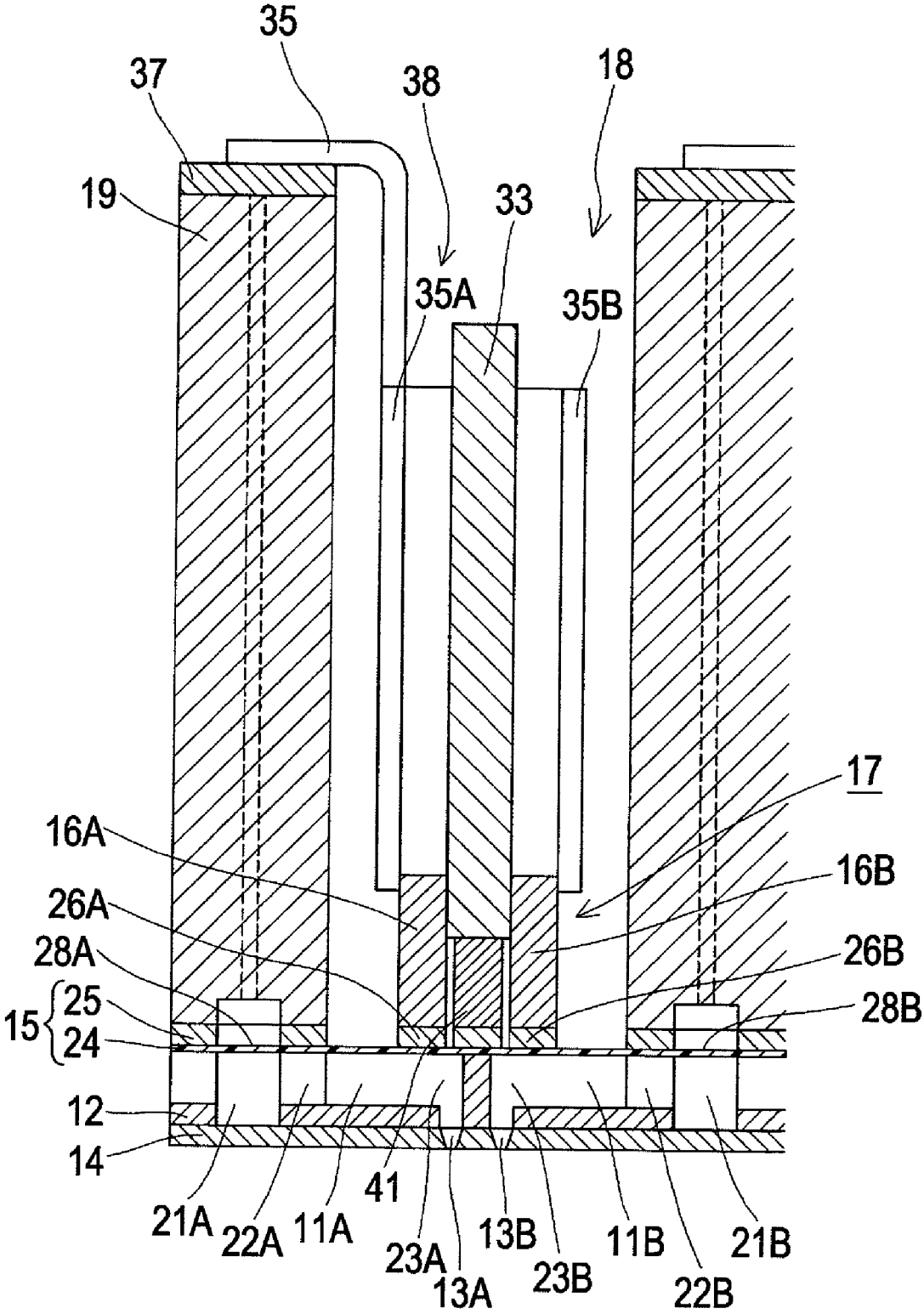
FIG. 2 is a cross-sectional view illustrating a main part of the recording head according to the embodiment.

Hereinafter, an embodiment of the invention is described in detail with reference to the drawings. FIG. 1 is a schematic cross-sectional view illustrating an ink jet recording head which is an example of a liquid ejecting head according to the embodiment of the invention. FIG. 2 is a cross-sectional view illustrating a main part of the ink jet recording head.

As shown in FIGS. 1 and 2, an ink jet recording head 10 of the embodiment includes two rows of pressure generating chambers 11A, 11B which communicate with nozzle openings 13A, 13B, respectively, and the nozzle openings 13A, 13B eject ink droplets. A plurality of the pressure generating chambers 11A, 11B are arranged in parallel in the direction perpendicular to the plane of paper in FIGS. 1 and 2 on a flow path forming substrate 12 to form a first pressure generating chamber row and a second pressure generating chamber row.

As described more in detail, the plurality of the pressure generating chambers 11A, 11B are arranged in parallel in the width direction of the flow path forming substrate 12 (the direction perpendicular to the plane of paper in FIGS. 1 and 2) in a surface layer on one face side of the flow path forming substrate 12. In this case, the plurality of the pressure generating chambers 11A, 11B are divided with partition walls. Reservoirs 21A, 21B are provided on the outside of the first and second pressure generating chamber rows, respectively, so as to penetrate through the flow path forming substrate 12 in the thickness direction thereof. The reservoirs 21A, 21B serve as common ink chambers (liquid chambers) for supplying inks to each of the pressure generating chambers 11A, 11B. The pressure generating chambers 11A, 11B are communicated with the reservoirs 21A, 21B, respectively, through ink supply paths 22A, 22B. The ink supply paths 22A, 22B are formed to have the widths narrower than those of the pressure generating chambers 11A, 11B in the embodiment. The ink supply paths 22A, 22B keep a constant resistance in flow paths of inks flowing into the pressure generating chambers 11A, 11B from the reservoirs 21A, 21B. Further, nozzle communicating holes 23A, 23B which penetrate through the flow path forming substrate 12 are formed at the end of the pressure generating chambers 11A, 11B opposite to the reservoirs 21A, 21B. Such flow path forming substrate 12 can be suitably formed with a silicon single crystal substrate, for example. The pressure generating chambers 11A, 11B, and the like provided on the flow path forming substrate 12 are suitably formed by etching the flow path forming substrate 12.

A nozzle plate 14 in which the nozzle openings 13A, 13B are bored so as to penetrate through the nozzle plate 14 is bonded to one face side of the flow path forming substrate 12 with an adhesive or a heat welding film. The nozzle openings 13A, 13B respectively communicates with the pressure generating chambers 11A, 11B through the nozzle communicating holes 23A, 23B provided on the flow path forming substrate 12. In addition, a vibration plate 15 is bonded to the other face of the flow path forming substrate 12, that is, to the face where the pressure generating chambers 11A, 11B have openings. Therefore, the pressure generating chambers 11A, 11B are sealed with the vibration plate 15.

The vibration plate 15 is formed of a composite plate including an elastic film 24 made of an elastic member such as a resin film, for example, and a supporting plate 25 made of a metal material or the like, for example. The supporting plate 25 supports the elastic film 24. A face of the elastic film 24 of the vibration plate 15 is bonded to the flow path forming substrate 12. Note that the elastic film 24 is made of a PPS (polyphenylene sulfide) film having a thickness of several μm and the supporting plate 25 is made of a stainless steel (SUS) plate having a thickness of several tens of μm. In addition, island portions 26A, 26B are provided at regions, which are opposed to the pressure generating chambers 11A, 11B, of the vibration plate 15 so that the distal ends of the piezoelectric devices 16A, 16B are abutted against the island portions 26A, 26B, respectively. In other words, each of the island portions 26A, 26B is provided on the inner side of thin wall portions having a thickness thinner than other regions. The thin wall portions are formed on the vibration plate 15 at regions opposed to peripheries of the pressure generating chambers 11A, 11B. Further, compliance portions 28A, 28B are provided at regions of the vibration plate 15 opposed to the reservoirs 21A, 21B. The compliance portions 28A, 28B are substantially configured of only an elastic film through the process of removing the supporting plate 25 by etching as the thin wall portions 27 in the embodiment. Note that the compliance portions 28A, 28B keep the pressures in the reservoirs 21A, 21B constant at any time as follows. That is, when the pressures in the reservoirs 21A, 21B change, the compliance portions 28A, 28B absorb the change in pressure by deforming the elastic film 24.

The first and second piezoelectric devices 16A, 16B, which cause the volumes of the first and second pressure generating chambers 11A, 11B to change through the vibration plate 15, form a piezoelectric device unit 17 together with a fixing member 33 and a leg portion 41. Each base end of the first and second piezoelectric devices 16A, 16B is bonded to the common fixing member 33 at both side faces which are perpendicular to the face on which the pressure generating chambers are formed. To be more specific, the piezoelectric device 16A is bonded to the fixing member 33 at one side face shown on the left side in FIG. 1 along the direction perpendicular to the plane of paper. The piezoelectric device 16B is bonded to the fixing member 33 at the other side face shown on the right side in FIG. 1 along the direction perpendicular to the plane of paper. Although not shown in the drawings, the piezoelectric devices 16A, 16B may be bonded to the fixing member 33 at a face facing the side at which the pressure generating chambers 11 are formed. In this case, the fixing member 33 should be thicker, and a face of the piezoelectric device 16A which is bonded to a first wiring portion 35A and a face of piezoelectric device 16B which is bonded to a second wiring portion 35B should be projected toward the flow path forming substrate 12 compared to the above side faces of the fixing member 33. This configuration brings an effect that the wiring portions 35A, 35B can be easily bonded to the piezoelectric devices 16A, 16B, respectively. It is to be noted that although the fixing member 33 can be suitably formed with SUS, for example, the material of the fixing member 33 is not limited thereto. In addition, the fixing member 33 is not limited to be formed of a single plate member and the fixing member 33 may be formed by laminating a plurality of plate members. Thus, when the fixing member 33 is formed of laminated plates, both side faces thereof refers not to both side faces of each laminated plate, but to both side faces of the fixing member 33 integrated by lamination.

The piezoelectric device 16A is made of a piezoelectric device forming member obtained by alternately laminating piezoelectric materials and electrode forming materials to be sandwiched and by cutting the piezoelectric device forming member into pieces having a comb-tooth form so that each of the cut piezoelectric device forming members corresponds to each pressure generating chamber 11A. The piezoelectric device 16B is also made by cutting the piezoelectric device forming member formed in the same manner into pieces having a comb-tooth form so that each of the cut piezoelectric device forming members corresponds to each pressure generating chamber 11B. That is to say, a plurality of piezoelectric devices in each of the piezoelectric devices 16A, 16B are integrally formed in the embodiment. Then, the base ends of the piezoelectric devices 16A, 16B are fixed to the fixing member 33. The distal ends of the piezoelectric devices 16A, 16B which are opposite to the base ends thereof are fixed to the island portions 26A, 26B of the vibration plate 15 in an abutment manner.

Further, a signal line film 35 is connected to the piezoelectric devices 16A, 16B at the side faces opposite to the side face where the fixing member 33 is bonded, in the vicinity of the base ends of the piezoelectric devices 16A, 16B. The signal line film 35 has wirings which supply signals for driving each of the piezoelectric devices 16A, 16B.

In the embodiment, one piezoelectric device unit 17 is formed with the leg portion 41, the fixing member 33, and the piezoelectric devices 16A, 16B arranged in two rows on the both sides of the common fixing member 33, respectively, so as to be opposed to each other. Therefore, the signal line film 35 for supplying driving signals to the piezoelectric devices 16A, 16B includes a first wiring portion 35A and a second wiring portion 35B. The first wiring portion 35A has an output terminal for supplying the driving signal to the first piezoelectric device 16A at one side face (left side in FIG. 1) of the fixing member 33. The second wiring portion 35B has an output terminal for supplying the driving signal to the second piezoelectric device 16B by extending around the fixing member 33 from the first wiring portion 35A to the other side face thereof (right side in FIG. 1). These portions will be described later in detail.

In the embodiment, the ink jet recording head 10 has four piezoelectric device units 17 each of which is accommodated in a corresponding portion among four accommodating portions 18. The four accommodating portions 18 are included in a head case 19 which is fixed on the vibration plate 15. That is to say, the ink jet recording head 10 of the embodiment includes total of four piezoelectric device units 17 each having piezoelectric devices 16A, 16B. Eight rows of the nozzle openings 13A, 13B are provided so as to correspond to the four piezoelectric device units 17 each having piezoelectric devices 16A, 16B.

A wiring substrate 37 provided with a plurality of conductive pads is fixed on the head case 19. Input terminals of wirings in the first and second wiring portions 35A, 35B of the signal line films 35 are connected to the plurality of conductive pads, respectively. The accommodating portions 18 in the head case 19 are substantially covered with the wiring substrate 37. In other words, slit-form openings 38 are formed on the wiring substrate 37 at regions opposed to the accommodating portions 18 in the head case 19. The signal line films 35 are drawn from the openings 38 of the wiring substrate 37 to the outside of the accommodating portions 18.

One opening 38 of the wiring substrate 37 is provided for each accommodating portion 18, that is, four openings 38 are provided in the embodiment. Thus, one signal line film 35 is drawn from one opening 38 of one piezoelectric device unit 17 provided in one accommodating portion 18.

The signal line film 35 is made of a flexible printed circuit (FPC) on which a driving IC (not shown) for driving the piezoelectric devices 16A, 16B is mounted, for example, made of a member having flexibility, such as a tape carrier package (TCP) and a chip on film (COF). Each wiring of the signal line film 35 is connected to an electrode forming material constituting the piezoelectric devices 16A, 16B with soldering, an anisotropic conductive material or the like at the base end of the wiring. On the other hand, each wiring of the signal line film 35 is bonded to each conductive pad of the wiring substrate 37 at the distal end of the wiring. To be more specific, each wiring of the signal line film 35 is bonded to each conductive pad of the wiring substrate 37 in a state where the distal end of the signal line film 35 is bended along the surface of the wiring substrate 37. In this case, the distal end of the signal line film 35 is drawn from the opening 38 of the wiring substrate 37 to the outside of the accommodating portion 18. In other words, the signal line film 35 is bonded to the conductive pads provided on the surface of the wiring substrate 37 in a state where the signal line film 35 is bended at an angle of about 90° at the opening 38 of the wiring substrate 37.

Figure 3A:
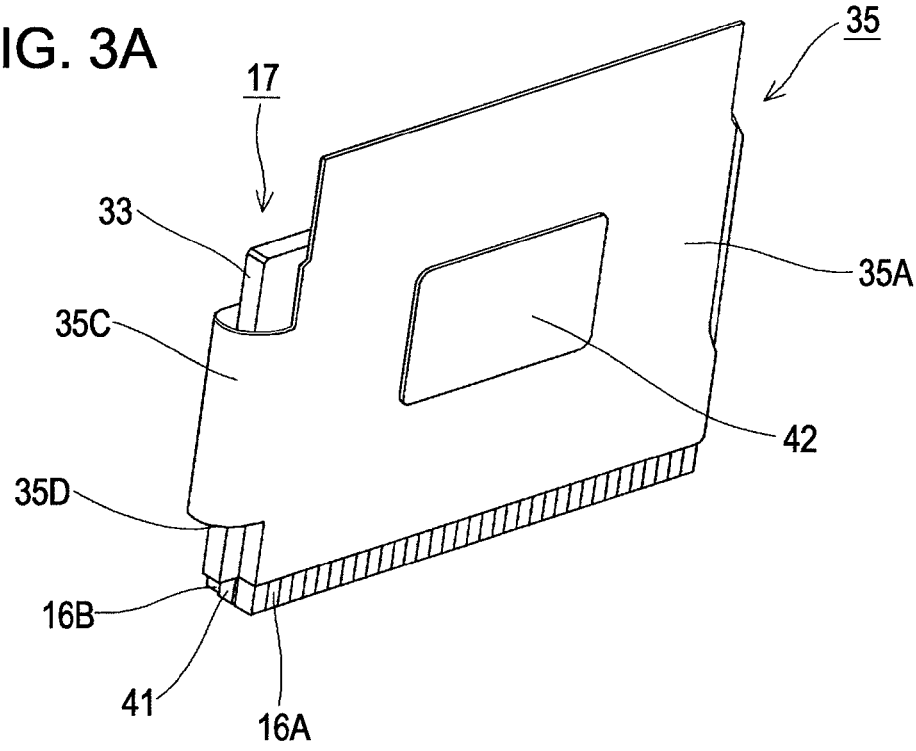
FIGS. 3A and 3B are schematic perspective views illustrating one piezoelectric device unit.
Figure 3B:
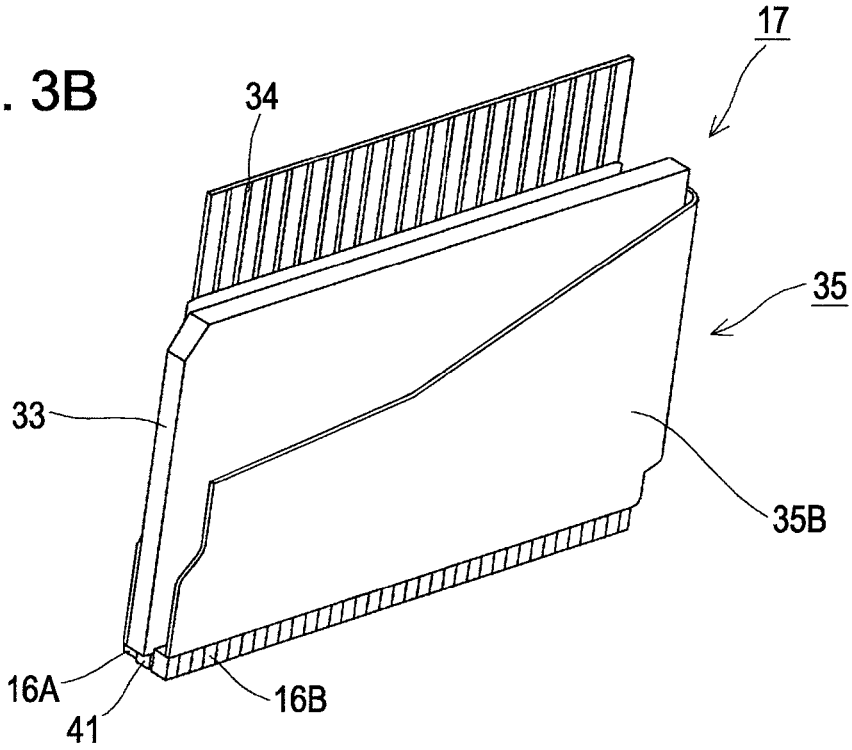

FIGS. 3A and 3B are views illustrating one of the piezoelectric device units 17 according to the embodiment, FIG. 3A is a schematic perspective view seen from one side and FIG. 3B is a schematic perspective view seen from the other side. As explicitly shown in FIGS. 3A and 3B, the signal line film 35 is formed of a flexible member and has input terminals through which a driving signal for driving the piezoelectric devices 16A, 16B is supplied through the wiring substrate 37 and output terminals through which the driving signal is supplied to the piezoelectric devices 16A, 16B. The signal line film 35 is electrically connected to the wiring substrate 37 through one wiring 34 through which the driving signal is supplied to the piezoelectric device 16B as well as the piezoelectric device 16A. Accordingly, the signal line film 35 includes the first wiring portion 35A and the second wiring portion 35B. The first wiring portion 35A has an input terminal connected to the wiring substrate 37 at one side face (right side face in FIG. 3A) of the fixing member 33 and an output terminal through which the driving signal is supplied to the piezoelectric device 16A. The second wiring portion 35B has an output terminal through which the driving signal is supplied to the piezoelectric device 16B by extending around the fixing member 33 from the first wiring portion 35A to the other side face (left side face in FIG. 3A). Namely, the signal line film 35 is configured such that the first wiring portion 35A and the second wiring portion 35B function as one circuit substrate with a coupling portion 35C bent around one end face of the fixing member 33. Further, although a driving IC 42 for selectively driving the piezoelectric devices 16A, 16B is mounted on the first wiring portion 35A only, the driving IC 42 drives not only the piezoelectric device 16A but also the piezoelectric device 16B.

An upper end face of the leg portion 41 is fixed to a lower end face of the fixing member 33. The lower end face of the fixing member 33 faces toward the pressure generating chambers 11. When the piezoelectric device unit 17 is integrated with the flow path forming substrate 12, the position of the piezoelectric device unit 17 is defined to a predetermined position by abutting the distal ends of piezoelectric devices 16A, 16B against the vibration plate 15. That is to say, the lower end face of the leg portion 41 is configured so as to be substantially identical to the distal end faces of the piezoelectric devices 16A, 16B. This makes it possible to not only improve the entire rigidity as the piezoelectric device unit 17 but also support a reaction force with the flow path forming substrate 12. The reaction force is generated by movement of the piezoelectric devices 16A, 16B in the vertical direction in FIG. 3. As described more in detail, since in the piezoelectric device unit 17 of the embodiment, the piezoelectric devices 16A, 16B are bonded to both side faces of the fixing member 33, respectively, the piezoelectric device unit 17 can stand without the leg portion 41 being provided. However, if the leg portion 41 is not provided, the piezoelectric device unit 17 does not have a portion for receiving the reaction force when the piezoelectric devices 16A, 16B are driven. Accordingly, the piezoelectric device unit 17 is configured such that the leg portion 41 is provided as described above to support the above reaction force.

It is to be noted that both right and left side faces of the leg portion 41, which are perpendicular to the bottom end face thereof, are formed to be flush with both of right and left side faces of the piezoelectric devices 16A, 16B.

A notch portion 35D is provided in the signal line film 35 such that an area of the side face of the fixing member 33, which is perpendicular to the faces thereof opposed to the first wiring portion 35A and the second wiring portion 35B, is exposed. To be more specific, the side face of the fixing member 33 is exposed at a region at which the piezoelectric device 16A and the piezoelectric device 16B are bonded to the fixing member 33. The notch portion 35D can contribute to easy positioning and fixing of the piezoelectric device unit 17 to the head case 19. This point is further described with reference to FIG. 4.

Figure 4:
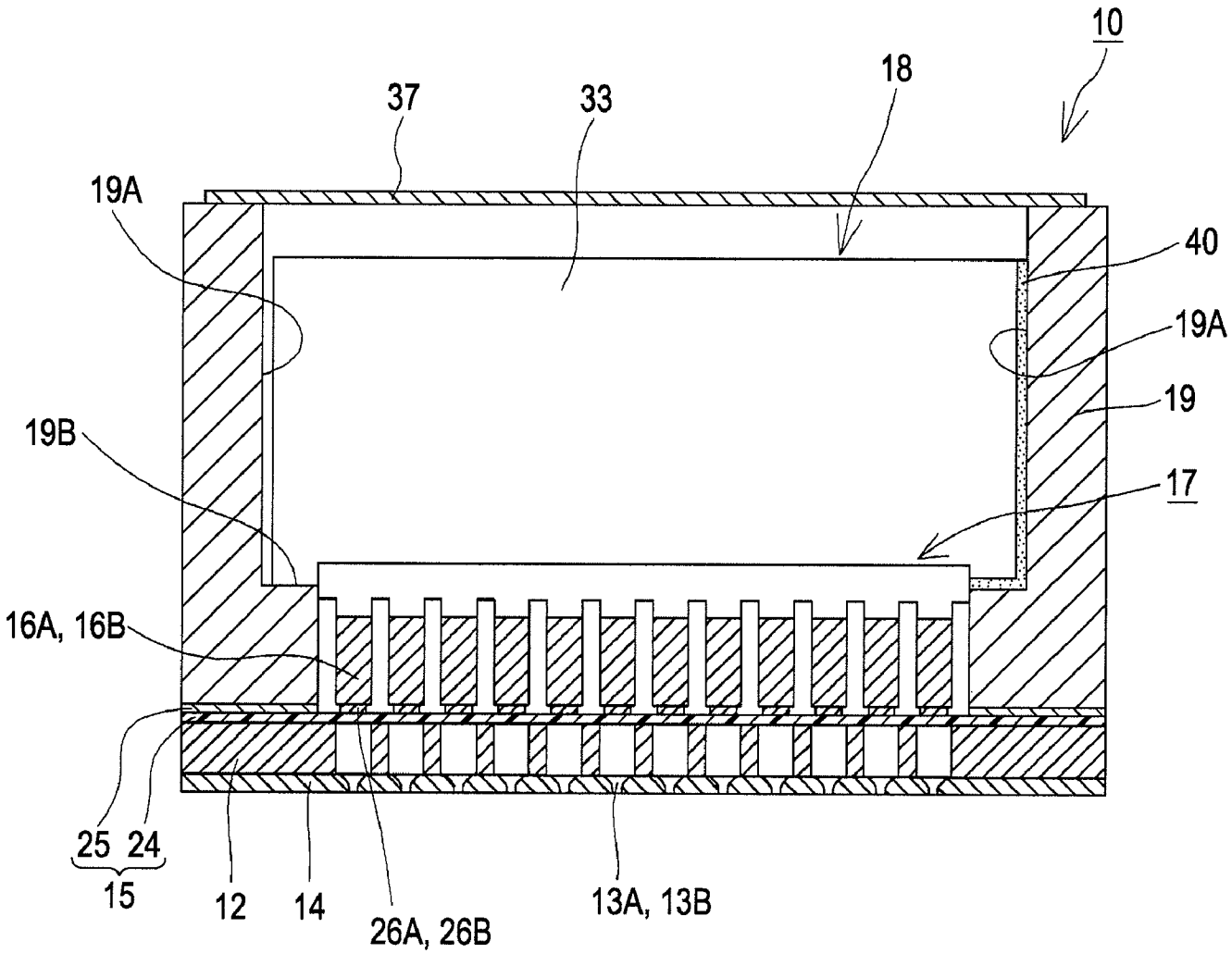
FIG. 4 is a schematic cross-sectional view illustrating a relationship between the piezoelectric device unit and a head case.

FIG. 4 is a schematic cross-sectional view illustrating a relationship between the piezoelectric device unit and a head case (the signal line film 35 is not shown). As shown in FIG. 4, a positional relationship between the piezoelectric devices 16A, 16B and the flow path forming substrate 12, particularly, the island portions 26A, 26B is kept with a predetermined accuracy by abutting both of the right and left side faces of the leg portion 41 together with the piezoelectric devices 16A, 16B against an inner wall face 19A of the accommodating portion 18 in the head case 19. Further, a positional relationship in the vertical direction is kept with a predetermined accuracy by abutting the lower end face of the fixing member 33 exposed with the notch portion 35D against a step portion 19B of the head case 19. After these components are positioned as described above, an adhesive 40 is injected between the end face of the fixing member 33 and the head case 19 for fixing.

In such ink jet recording head 10, ink droplets are discharged from predetermined nozzle opening 13A, 13B by changing volume of each pressure generating chamber 11 with deformations of the piezoelectric devices 16 and the vibration plate 15. To be more specific, when inks are supplied to the reservoirs 21A, 21B from an ink cartridge (not shown), inks are distributed to each of the pressure generating chambers 11A, 11B through the ink supply paths 22A, 22B. In this case, the piezoelectric devices 16A, 16B are selectively contracted by applying an voltage to the piezoelectric devices 16A, 16B through the first and second wiring portions 35A, 35B of the signal line film 35. Therefore, the vibration plate 15 as well as the piezoelectric devices 16A, 16B are deformed so that volumes of the pressure generating chambers 11A, 11B are expanded and inks are introduced to the pressure generating chambers 11A, 11B. After the nozzle openings 13A, 13B in addition to the pressure generating chambers 11A, 11B are filled with inks, the voltage applied to the electrode forming materials of the piezoelectric devices 16A, 16B is released when receiving the driving signal supplied through the wiring substrate 37. Accordingly, the piezoelectric devices 16A, 16B are expanded and returned to the original state, and the vibration plate 15 is also displaced and returned to the original state. As a result, volumes of the pressure generating chambers 11A, 11B are contracted to increase the pressures in the pressure generating chambers 11A, 11B. Ink droplets are discharged from the nozzle openings 13A, 13B.

An embodiment of the invention has been described above. However, the basic configuration of the invention is not limited to that described above. The basic configuration of the invention is not particularly limited as long as a driving signal can be supplied to the piezoelectric devices 16A, 16B through a single signal line film. In this case, the piezoelectric devices 16A, 16B are arranged so as to be opposed to both side faces of the fixing member 33. Accordingly, the leg portion 41 may be optionally fixed to the fixing member 33. However, when the leg portion 41 is provided, not only the rigidity of the piezoelectric device unit 17 can be improved, but also the head case 19 can be attached after the piezoelectric device unit 17 is fixed to the flow path forming substrate 12. That is to say, the piezoelectric device unit 17 is fixed to the flow path forming substrate 12 by adjusting the position of the piezoelectric device unit 17 with the leg portion 41 such that positions of the piezoelectric devices 16A, 16B are aligned with the island portions 26A, 26B, respectively. Thereafter, the head case 19 can be fixed to the flow path forming substrate 12 from the upper side of the piezoelectric device unit 17. In this case, the piezoelectric devices 16A, 16B can be aligned with high accuracy while visually checking the positions of the piezoelectric devices 16A, 16B with respect to the island portions 26A, 26B.

Two driving ICs may be provided so as to correspond to each of the piezoelectric devices 16A, 16B although having a disadvantage that the number of components is increased. Further, a pressure generating unit in which heating devices are arranged in the pressure generating chambers and liquid droplets are discharged from the nozzle openings with bubbles generated by heat of the heating devices may be used as pressure generating units. In addition, a so-called electrostatic actuator in which liquid droplets are discharged from the nozzle openings by generating static electricity between the vibration plate and the electrode, and deforming the vibration plate with the generated force by the static electricity may be also used as pressure generating units.

Figure 5:
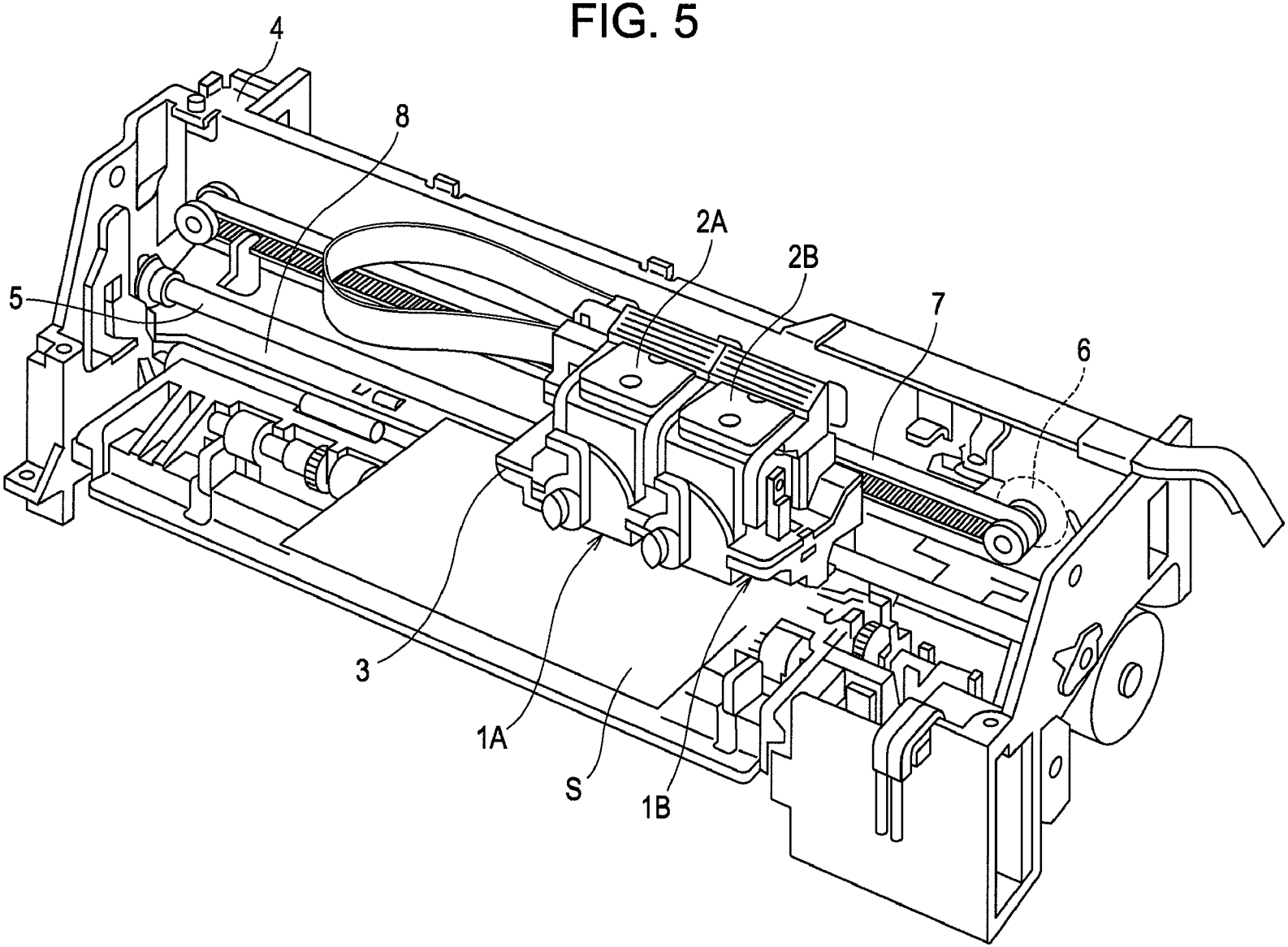
FIG. 5 is a schematic configuration view illustrating a recording apparatus according to the embodiment.

The ink jet recording head as described above constitutes a part of a recording head unit including ink flow paths communicating with ink cartridges or the like. The ink jet recording head is mounted on the ink jet recording apparatus. FIG. 5 is a schematic view illustrating an example of the ink jet recording apparatus.

In the ink jet recording apparatus as shown in FIG. 5, cartridges 2A, 2B constituting ink supply units are detachably attached to recording head units 1A, 1B having the ink jet recording heads. A carriage 3 on which the recording head units 1A, 1B are mounted is provided on a carriage shaft 5 attached movably in the direction of the carriage shaft 5 to an apparatus main body 4. For example, the recording head units 1A, 1B discharge black ink compositions and color ink compositions, respectively.

Driving force of a driving motor 6 is transmitted to the carriage 3 through a plurality of gears (not shown) and a timing belt 7 so that the carriage 3 on which the recording head units 1A, 1B are mounted is moved along the carriage shaft 5. A platen 8 is provided to the apparatus main body 4 along the carriage shaft 5 so that a recording sheet S which is a recording medium such as a paper fed by a feeding roller (not shown) is transported by winding the sheet S around the platen 8.

In the embodiment described above, the ink jet recording head is used as an example of liquid ejecting heads. However, the invention widely directs to liquid ejecting heads in general and the invention can be applied to a liquid ejecting head for ejecting liquids other than inks, of course. Other liquid ejecting heads include various types of recording heads used for an image recording apparatus such as a printer, a color material ejecting head used for manufacturing such color filters as those used for a liquid crystal display, an electrode material ejecting head used for forming such electrodes as those used for an organic EL display and a field emission display (FED), a bioorganic compound ejecting head used for manufacturing bio chips, and the like.

What is claimed is:

1. A liquid ejecting head comprising:

first and second pressure generating chambers which are provided in parallel on a flow path forming substrate such that each of the first and second pressure generating chambers forms a row so as to communicate with nozzle openings for ejecting liquids;

first and second piezoelectric devices each of which causes the volumes of the first and second pressure generating chambers to change, respectively, through a vibration plate formed on the flow path forming substrate;

a common fixing member which is arranged between the first and second piezoelectric devices at a position opposite to the first and second pressure generating chambers, a part of each of the first and second piezoelectric devices being bonded to the common fixing member; and a signal line film which has input terminals through which a driving signal for driving the first and second piezoelectric devices is supplied from the outside and output terminals through which the driving signal is supplied to the first and second piezoelectric devices, the signal line film having flexibility, wherein the signal line film includes:

a first wiring portion having the input terminals and the output terminals for supplying the driving signal to the first piezoelectric devices at one side face of the fixing member;

a second wiring portion extending from the first wiring portion to the other side face of the fixing member and having the output terminals for supplying the driving signal to the second piezoelectric devices;

a coupling portion coupling the first wiring portion to the second wiring portion by extending from the first wiring portion to the other side face of the fixing member; and a notch portion, which is provided at a region of the signal line film, close to the flow path forming substrate as compared to the coupling portion; and wherein the signal line film is configured such that end face of the fixing member, which is bonded to the piezoelectric devices, is exposed through the notch portion.

2. The liquid ejecting head according to claim 1, further comprising a leg portion which is fixed to an end face of the fixing member between the first and second piezoelectric devices and defines the positions of the end faces of the first and second piezoelectric devices on the side of the vibration plate.

3. The liquid ejecting head according to claim 1, wherein one driving IC arranged on the first wiring portion drives each of the first and second piezoelectric devices.

4. A liquid ejecting apparatus comprising the liquid ejecting head according to claim 1.

* * * * *